US005597449A

United States Patent [19]

Vestola et al.

[11] Patent Number: 5,597,449

[45] Date of Patent: Jan. 28, 1997

[54] METHOD AND DEVICE FOR CONDITIONING THE COATING OF A PAPER MACHINE ROLL

[75] Inventors: Juhani Vestola; Pekka Harinen, both of Jyväskylä , Finland

[73] Assignee: Valmet Corporation, Helsinki, Finland

[21] Appl. No.: 298,328

[22] Filed: Aug. 30, 1994

[30] Foreign Application Priority Data

Apr. 8, 1994 [FI] Finland ..... 941620

[51] Int. Cl.[6] ..... D21F 1/32; B24B 1/00

[52] U.S. Cl. ..... 162/199; 162/272; 162/274; 162/276; 451/49; 451/424

[58] Field of Search ..... 162/272, 276, 162/199, 274, 275; 451/49, 348, 424, 425, 426, 451, 460, 489, 913; 15/256.51

[56] References Cited

U.S. PATENT DOCUMENTS

| | | | |
|---|---|---|---|
| Re. 29,417 | 9/1977 | Lee et al. | 162/274 |
| 3,775,241 | 11/1973 | Justus et al. | 162/199 |
| 3,840,933 | 10/1974 | Schwab et al. | 15/236 |
| 4,078,486 | 3/1978 | Moser | 101/120 |
| 4,382,558 | 5/1983 | Svensson | 241/30 |
| 4,575,972 | 3/1986 | Ohki et al. | 51/251 |
| 4,834,926 | 5/1989 | Iwasaki et al. | 264/65 |
| 4,936,052 | 6/1990 | Nagase et al. | 51/34 |
| 5,104,697 | 4/1992 | Heikkinen et al. | 427/356 |
| 5,123,152 | 6/1992 | Tenkula et al. | 29/132 |

FOREIGN PATENT DOCUMENTS

| | | |
|---|---|---|
| 890635 | 8/1990 | Finland . |
| 3406160 | 8/1984 | Germany . |

OTHER PUBLICATIONS

Tekniikan Kasikirja (Reference Book of Engineering), No. 9, p. 372, Table 2 and p. 373, column 2, second paragraph.

*Primary Examiner*—Donald E. Czaja
*Assistant Examiner*—Calvin Padgett
*Attorney, Agent, or Firm*—Steinberg, Raskin & Davidson, P.C.

[57] ABSTRACT

A method and device for conditioning a ceramic or metal-ceramic coating of a paper machine roll at its operating site. The roll is ground periodically by a grinding member mounted on a doctor of the roll. The grain size of the grinding particles in the grinding member, i.e., the average diameter of the particles, is in the range of from about 15 to about 200 μm. In the grinding situation, the roll is rotated in its site of operation, and the grinding member is pressed with a force into contact with the face to be ground, whereby, if the face to be ground is excessively rough, it is smoothed to the desired value of surface roughness and, in a corresponding manner, an excessively smooth face is roughened to the desired surface roughness value determined by the grinding member.

25 Claims, 5 Drawing Sheets

METHOD AND DEVICE FOR CONDITIONING THE COATING OF A PAPER MACHINE ROLL

BACKGROUND OF THE INVENTION

The present invention relates to a method and device for conditioning the coating of a paper machine roll.

In the art of paper making, it is known that a porous face of a press roll, such as the center roll in a compact press section, tends to gather and to be coated with the doctor material, such as epoxy. If the coating is excessive, the roll face may become excessively smooth, which results in a more difficult separation of the paper web from the center roll of the press section and in passage of the web into contact with and possibly through the doctor, resulting in a tendency of web breaks. Also, an excessive roughening of the roll face results in similar deterioration of the capacity of operation of the face. Smoothing and roughening of the roll face is particularly relevant and important for a roll that includes a ceramic coating material.

It is also known in the prior art that in order for the roll face to be kept at its desired optimal roughness value (RA value) in view of the operation the roll is being subjected to, the roll face must be ground.

Often, it is necessary to completely remove the roll to perform smoothing or roughening operations on the roll face. This is a significant disadvantage because it results in work stoppages.

OBJECTS AND SUMMARY OF THE INVENTION

Accordingly, it is an object of the present invention to provide a method and device for periodically conditioning a roll face on site without removing the roll.

In accordance with the present invention, the doctor of the roll to be conditioned is provided with a separate grinding member, which is mounted on the actuators of the doctors and which is brought, by means of the doctor, into contact with the roll face to be ground. The grinding members comprise a back-up part shaped to closely correspond to the curved form of the roll face and a grinding band and a separate soft cushion part attached to the back-up part. The cushion part permits an elastic grinding result and enables flexibility and consideration to be enabled for any differences in shape between the face of the grinding member and the roll face which engage with, and are placed against, each other during grinding. In this manner, the roll is ground in its site of operation eliminating the need to completely remove the roll from its mounting arrangement.

In accordance with the invention, it is important that a grinding member is chosen with which the grinding result is always correct irrespective of whether the roll face is to be made smoother by grinding or whether an excessively smooth face is to be roughened. Thus, according to the invention, a separate grinding member is used in which the diameter size of the grinding particles is in the range from about 15 μm to about 200 μm. Preferably, a diamond grinding band is used. During grinding, the grinding member is oscillated in the axial direction of the roll, which is transverse to the rotating direction of the roll, whereby the oscillation device of the doctor is used for the oscillation of the grinding member. During operation, the grinding member is pressed with a force of about 100 to about 1200 N/m (force per unit of length) against the face to be ground. The roll is rotated at a low circumferential speed of about 10 m/min to about 200 m/min. Preferably, a water jet is applied to the roll face in proximity to the location in which the roll face grinding is occurring so that the water film provided by the jet carries the ground material away and also acts as a cooling medium.

In the present invention, the term "ceramic roll" is used to describe a roll with a ceramic or metal ceramic coating. The coating material is preferably an oxide ceramic, for example Al, Ca, Cr, Mg, Si, Ti, Zn, or Y oxide, or a carbide ceramic, for example Cr, Ni, Ti, or W carbide, or a boride ceramic, for example Ti boride, or a mixture or compound of these components. Among these ceramics, it is also possible to alloy metals, for example Al, Cr, Co, Fe, Mo, Ni, Si, or alloys of the materials.

Briefly, the method for conditioning a ceramic or metal-ceramic coating of a paper machine roll, with the roll situated in the paper machine at its operating site, comprises mounting a grinding member having particles on a doctor of the roll in proximity to the roll, the grain size of the particles in the grinding member being in a range from about 15 μm to about 200 μm, and grounding the roll face by periodically pressing the grinding member into contact with a face of the roll while simultaneously rotating the roll, e.g., at a circumferential speed from about 10 m/min to about 200 m/min. In this manner, if the roll face to be ground is excessively rough, it is smoothed by the grinding member to a desired surface roughness value and if the roll face to be ground is excessively smooth, it is roughened by the grinding member to desired surface roughness value. The surface roughness value to which the roll face is smoothed or roughened is determined by the grinding member.

In addition, it is preferable to move the doctor and thus the grinding member to press against the roll face during grinding via an actuator, with a force of about 100 N/m to about 1200 N/m, and to oscillate the grinding member in an axial direction of the roll via an oscillation actuator. Cushion material may be arranged between the grinding member and the doctor which has the capability of being deformed to permit the grinding member to adapt itself to the shape of the roll face being ground such that any variations in the surface pressure arising from inaccuracies in the contact between the roll face being ground and the grinding member are equalized.

The device for conditioning a ceramic or metal-ceramic coating of a paper machine roll which has a doctor in operative relationship therewith, comprises grinding means for grinding a face of the roll, means for supporting the grinding means, e.g., a grinding back-up part or the doctor blade itself, and coupling means for detachably coupling the support means to the doctor or the doctor blade. Cushion material is arranged to absorb shock between the grinding means, also referred to as a grinding member, and the grinding back-up part or the blade. The length of the grinding member in a circumferential direction of the roll over which the grinding member is positionable in contact with the roll face being ground is in the range from about 7 mm to about 200 mm, preferably about 10 mm to about 100 mm. Spray means such as a jet pipe are arranged to direct a grinding medium at the roll face in the vicinity of the grinding member, preferably before the grinding member in a rotating direction of the roll to carry away particles that have been ground loose and to cool the roll face. The device also comprises means for periodically moving the grinding member into contact with the roll face to perform grinding operations, e.g., smoothing or roughening as desired. The coupling means comprise a pivot frame connected to the doctor via an articulated joint and loading means for adjustably loading the pivot frame relative to the doctor. The pivot frame includes means for retaining the doctor blade.

The invention will be described in the following with reference to some preferred embodiments of the invention illustrated in the figures in the accompanying drawings. However, the invention is not confined to the illustrated embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1A:
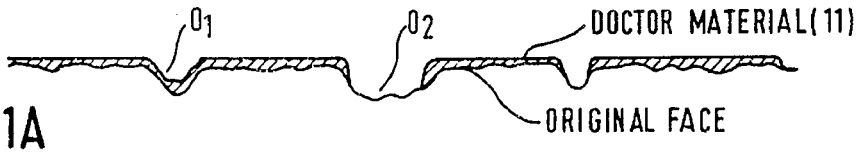
FIG. 1A is a schematic illustration of the smoothing of a roll face.

Referring to the drawings in which like numerals refer to the same or corresponding elements, FIG. 1A illustrates the cross-sectional structure of a ceramic roll face in a smoothing stage of the roll face. The material illustrated by the diagonal shading represents doctor material 11. In the smoothing stage of the roll face, especially for a thermally sprayed face, the doctor material is scratched so that sharp-edged recesses $O_1$, $O_2$ . . . , which are produced in connection with grinding, tend to be filled resulting in smoothing of the roll face.

Figure 1B:
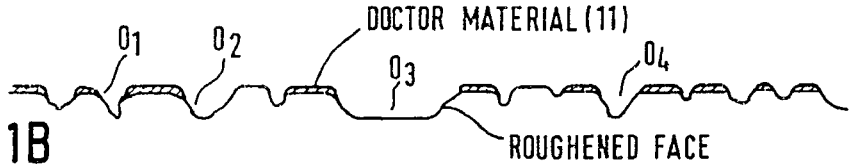
FIG. 1B is a schematic illustration of the roughening of a roll face.

FIG. 1B shows a second case in which the roll face becomes rough, i.e., illustrating the roughening operation. In FIG. 1B, the doctor material 11 is illustrated by the shaded areas. If the number and the size of the abrading particles entering between the blade and the roll are large, the abrading particles start scratching the layer of doctor material that is being formed more rapidly than it can be renewed. In this manner, first the layer of doctor material is broken, and then roughening of the ceramic layer becomes possible. By means of a grinding treatment, a new plane face is formed on the face, which promotes the formation of a layer of doctor material.

Figure 2A:
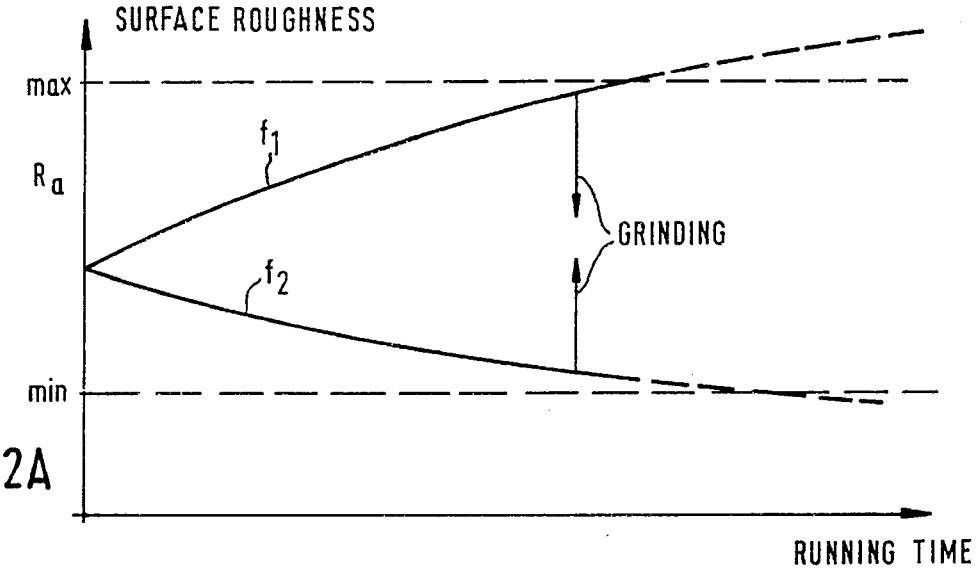
FIG. 2A shows graphs $f_1$, $f_2$ representing the surface roughness of the roll face, wherein the curve $f_1$ represents the roughening of the roll face and the curve $f_2$ represents the smoothing of the roll face.

In FIG. 2A, curve $f_1$ represents the roughening of the roll face, i.e. the situation of FIG. 1B, in a system of coordinates of surface roughness/running time of the roughening stage. During the running time, the surface roughness approaches a certain maximal value.

In FIG. 2A, curve $f_2$ represents the tendency of smoothing of the roll face. Depending on the particular case, the rate of change in the roughness may vary even to a considerable extent. The maximal value of surface roughness approaches the RA value 2, and the minimal value of surface roughness approaches the RA value 0.2. At the stage $t_1$, grinding is carried out in accordance with the invention.

Figure 2B:
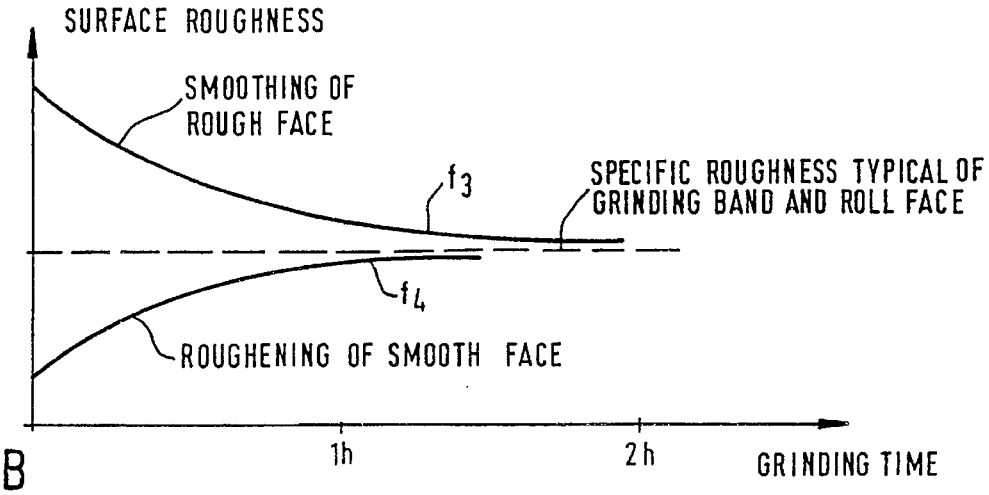
FIG. 2B illustrates the grinding stage, in which the curve $f_3$ represents the smoothing of the roll face during grinding, and the curve $f_4$ represents the roughening of a smooth face during grinding.

As shown in FIG. 2B, in the stage $t_1$, the face is ground by means of the grinding member, in which the average diameter size of the particles, i.e. the diameter of the granule (particle size), is in the range of from about 15 to about 200 μm. Irrespective of whether the starting point is an excessively rough face or an excessively smooth face, the desired surface roughness is achieved. Curve $f_3$ illustrates the smoothing of a rough roll face taking place during grinding, and curve $f_4$ illustrates the roughening of a smooth roll face taking place during grinding. The final result is obtained with a grinding time of about one to two hours.

Figure 3A:
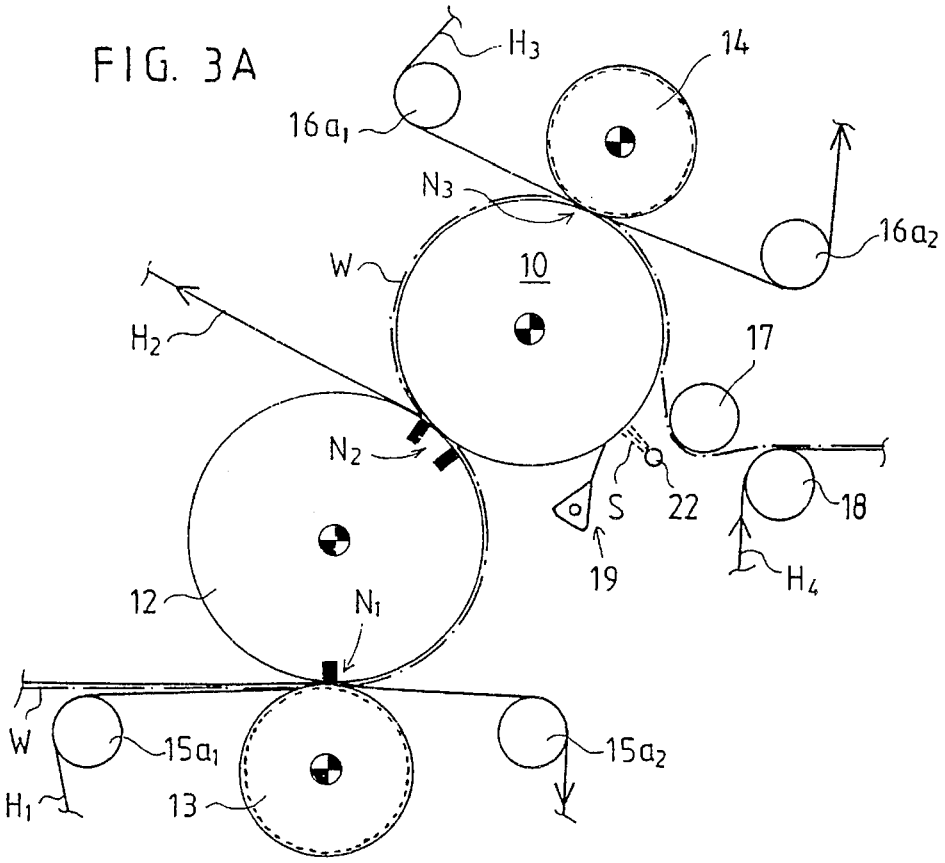
FIG. 3A shows a press section of a paper machine in a running situation in which the method and device in accordance with the invention can be applied.

FIG. 3A is a schematic illustration of the press section of a paper machine in a running situation. The press section shown in FIG. 3A comprises a center roll 10 coated with a ceramic coating in accordance with the invention, a press roll 12 and a back-up roll 13. Between the press roll 12 and the back-up roll 13, a nip $N_1$ formed, between the center roll 10 and the press roll 12, a nip $N_2$ is formed, and between the center roll 10 and another back-up roll 14, a nip $N_3$ is formed. A felt $H_2$ and a paper web W are passed through the nips $N_1$ and $N_2$. In a corresponding manner, a felt $H_1$ is passed through the nip $N_1$ and over felt guide rolls 15$a_1$, 15$a_2$. After the nip $N_2$, the web is passed along an outer face 10' of the center roll 10, while adhering to the roll face, into the nip $N_3$, into which a felt $H_3$ is also passed. The felt $H_3$ is passed over felt guide rolls 16$a_1$, 16$a_2$.

After the nip $N_3$, the web is passed a certain distance along the roll face 10' of the center roll 10, and is transferred over roll 17 into connection with a felt $H_4$. Felt $H_4$ is guided over a felt guide roll 18. Under these circumstances, in press roll operation, very good and accurate properties are required from the face of the center roll 10 so that, for example, in connection with threading and in a running situation, the web W can be transferred readily into connection with the center roll and the web can be passed away from the center roll. In view of the quality of the paper that is produced, the properties of the roll face are also essential. If changes in the surface values take place on the ceramic material of the roll 10, the running situation is not under control. Thus, in accordance with the invention, the ceramic material of roll 10 should be ground periodically, i.e., at certain regular time intervals, for example in connection with suitable standstills when changing felts.

Figure 3B:
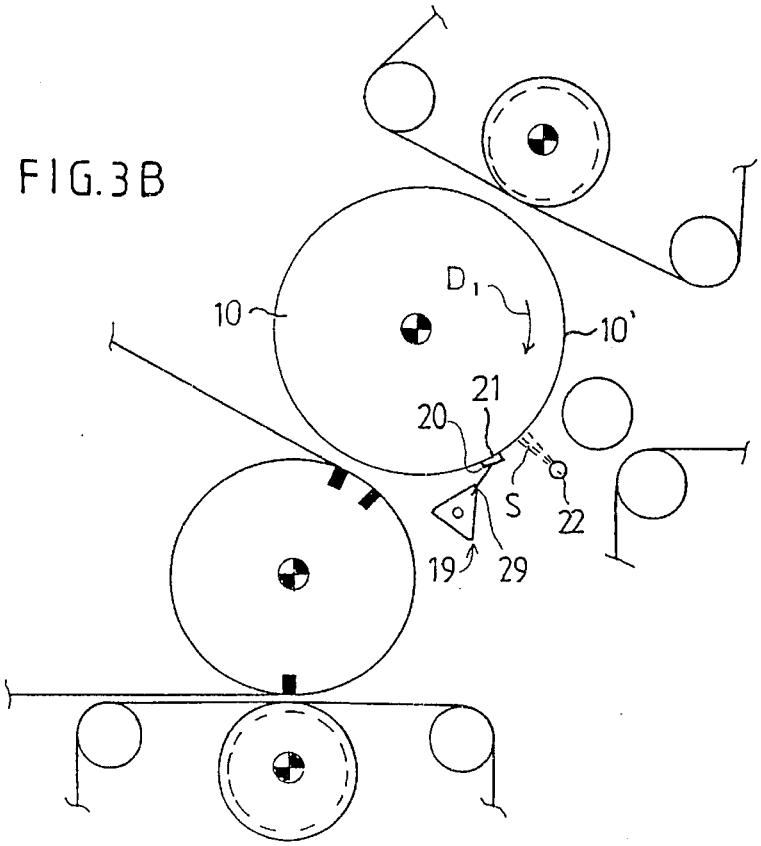
FIG. 3B shows the grinding in accordance with the invention of the center roll of a press section.

FIG. 3B shows a method and device for grinding the center roll in accordance with the invention which is usually applied when the nips $N_1$, $N_2$, $N_3$ have been opened and the center roll 10 is driven by its own drive gear during a crawling operation. Alternatively, the roll 10 may be driven by means of the drive of a back-up roll while the nip or nips are closed. The direction of rotation of the roll 10 is indicated by arrow $D_1$. In accordance with the invention, a doctor device 19 is arranged in connection with the center roll 10 and comprises a doctor blade 29. At the end of the blade 29 of the doctor device 19, a grinding back-up part 20 is mounted. Grinding back-up part 20 includes a grinding member 21 which is preferably a diamond grinding band. The grinding band is in contact with the roll face 10' to be ground over a defined circumferential distance L. It is important that the distance L is in the range of about 7 to about 200 mm, preferably from about 10 to about 100 mm. In this case, an adequate number of grinding particles are in contact with the face to be ground in each position of the circumference so that, during grinding, the material to be ground does not exhaust the grinding member 21 and changing of the grinding member 21 during each grinding cycle can be avoided. The grinding usually takes about 1 to about 2 hours, and breaks in time are not necessary during grinding.

The speed of the roll 10 circumference that is used in the grinding situation is preferably in the range of from about 10 to about 200 m/min.

Figure 4A:
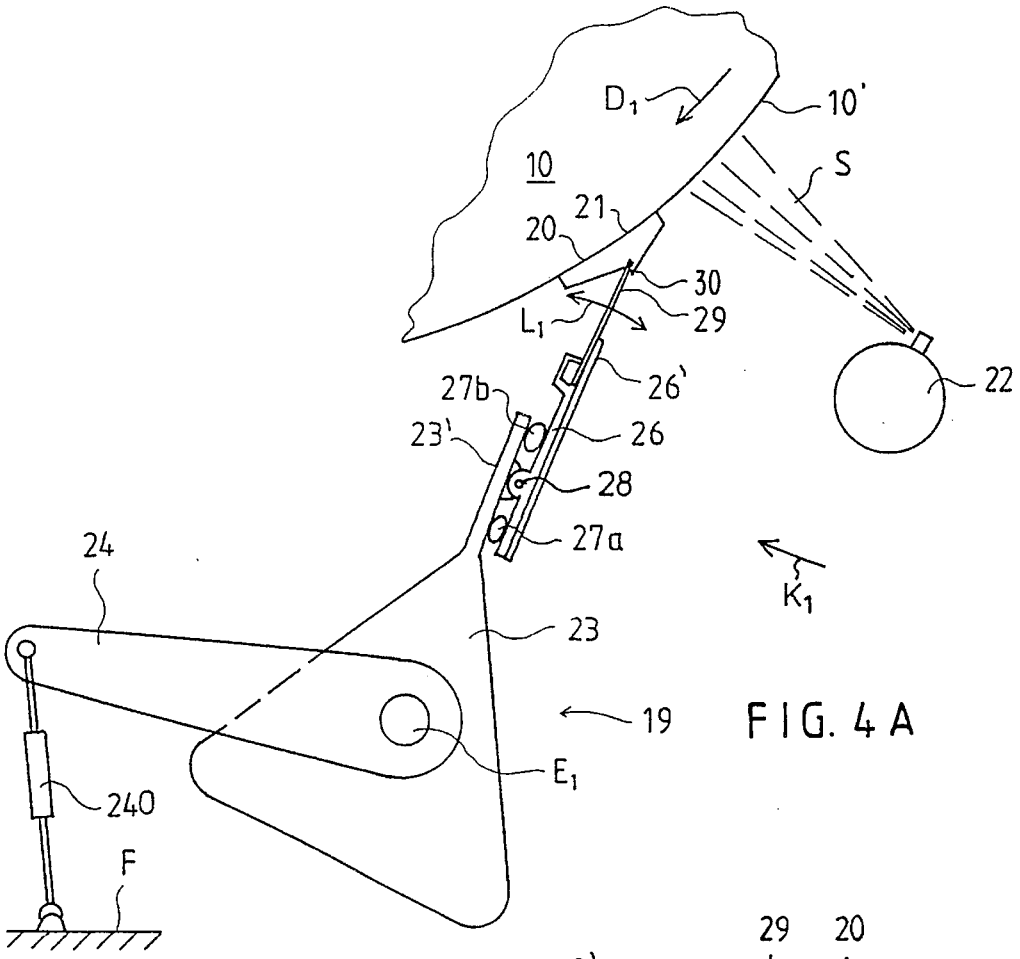
FIG. 4A is a more detailed side view of the grinding device in accordance with the invention and corresponds to a cross-sectional view taken along the line I—I in FIG. 4B.
Figure 4B:
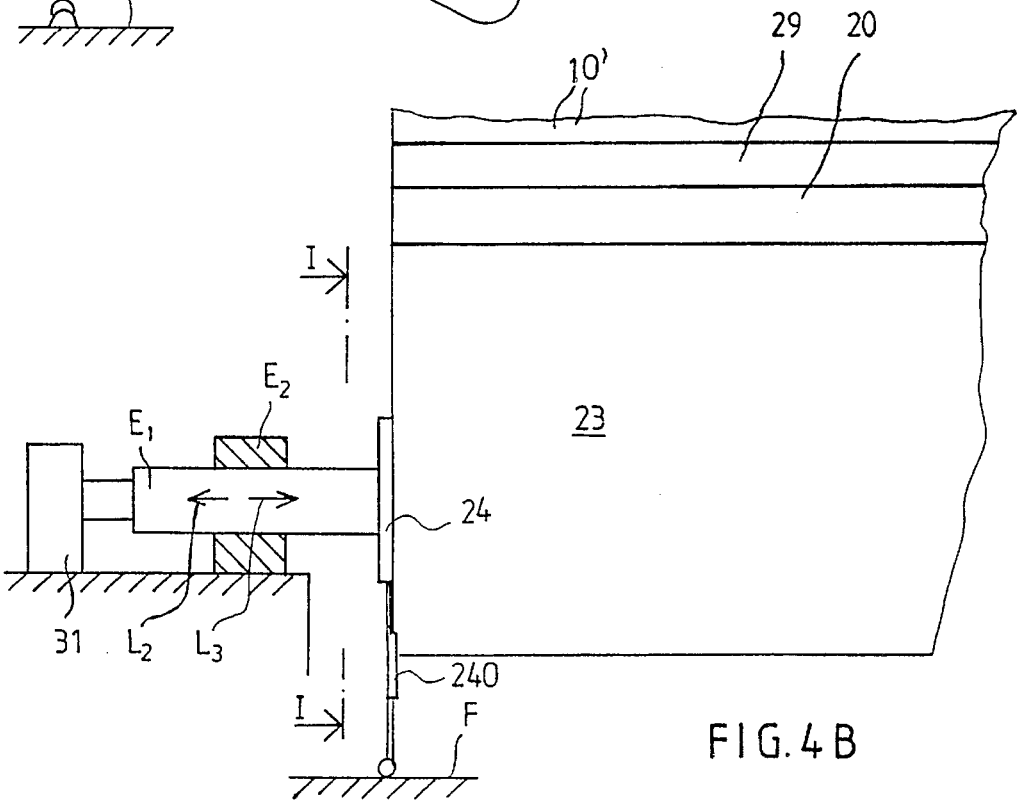
FIG. 4B shows the device in accordance with the invention viewed in the direction of arrow $K_1$ in FIG. 4A.

FIG. 4A is a side view of the grinding arrangement on an enlarged scale and is a cross-sectional view taken along the line I—I in FIG. 4B. As shown in FIG. 4A, the doctor 19 comprises a doctor beam 23 which is connected with a pivot arm 24. Between the pivot arm 24 and the frame F, there is an actuator 240, for example a cylinder device or a stud screw, for displacing the doctor beam 23 via its coupling to the pivot arm 24. By means of the actuator 240, the doctor beam 23 can also be locked in the direction of rotation in a desired position of operation.

The doctor device 19 further comprises a pivot frame 26 connected with a projection part 23' of the doctor beam 23 and fitted to pivot on an articulated joint 28. Between the pivot frame 26 and the projection part 23', loading means, e.g., loading hoses **27*a* and 27*b*, are placed at both sides of the pivot joint 28. By means of the loading hoses 27*a*, 27*b*, the pivot frame 26 can be pivoted on the pivot joint 28 (arrow $L_1$). In this manner, the blade 29 can be pressed, together with the grinding member 21 attached to it, with a force into contact with the face 10' to be ground. The blade 29 is arranged in a cavity 26' in the end of the pivot frame 26**.

The grinding back-up part 20 is mounted by means of an articulation point 30 on the end of the blade 29. The grinding back-up piece 20 comprises the grinding member 21 which may be a grinding band, preferably a diamond grinding band. The average particle size of the grinding particles in the grinding member 21 is in the range from about 15 to about 200 μm.

The device may be used in conjunction with a jet pipe 22 which produces a water jet S sprayed onto the face to be ground, whereby the grinding material can be carried away from the roll face 10' along with the water.

FIG. 4B shows the device of FIG. 4A viewed in the direction of arrow $K_1$ in FIG. 4A. An oscillation actuator 31 is arranged to displace the shaft $E_1$ of the doctor device 19, which shaft $E_1$ is supported in the bearing housing $E_2$. The movement of oscillation in both axial directions of the roll, and thus of the doctor device 19, is illustrated by the arrows $L_2$, $L_3$. The doctor device 19 is ideally aligned with the axial direction of the roll 10.

Figure 5A:
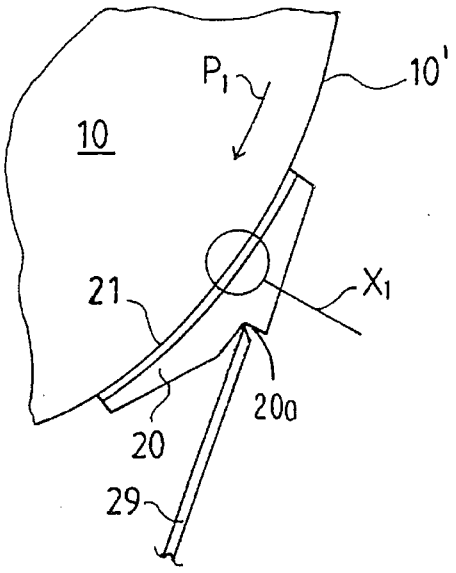
FIG. 5A shows the contact of the grinding member with the roll face to be ground on an enlarged scale.

FIG. 5A is an enlarged illustration of the connection of the back-up part 20, and the grinding member 21 arranged on the same, with the face 10' to be ground. The back-up part 20 has a shape or curvature $R_1$ which closely corresponds to the radius $R_2$ of the roll 10. The blade 29 of the doctor is mounted in a groove **20*a* in the back-up part 20. The groove 20*a* runs in the back-up part 20 on its outer face 20" across substantially the entire width of the roll 10** to be ground.

Figure 5B:
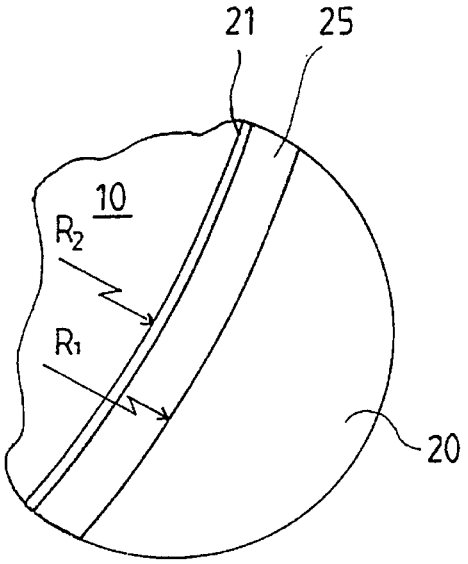
FIG. 5B shows the area $X_1$ in FIG. 5A.

FIG. 5B shows the area $X_1$ in FIG. 5A. The grinding member 21 is in contact with the roll face 10' preferably over the circumferential distance L. The length of the area L is in the range of from about 7 to about 200 mm, preferably from about 10 to about 100 mm. Cushion material 25 is placed between the grinding band 21 and the grinding back-up part 20 to absorb forces applied during the grinding operation.

Figure 6A:
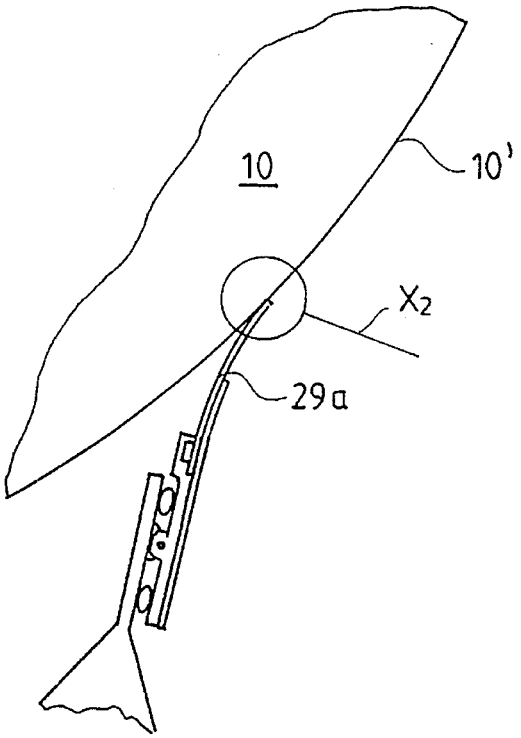
FIG. 6A shows a second embodiment of the device in accordance with the invention wherein a grinding band is attached directly to a doctor blade.
Figure 6B:
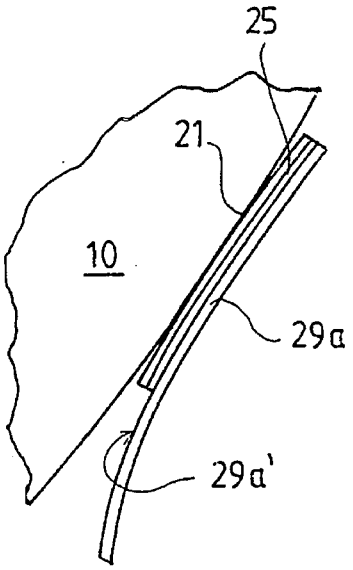
FIG. 6B shows the area $X_2$ in FIG. 6A.

FIG. 6A shows a second embodiment of the doctor device 19 in accordance with the invention, in which an excessively wide and flexible blade **29*a* is fixed to the doctor 19. The grinding member or band 21 is fixed to a face 29'*a* of the blade 29*a* oriented toward the roll 10 and the cushion material 25 is arranged between the grinding band 21 and the blade face 29*a'* of the blade 29*a***. FIG. 6B is an enlarged illustration of the area $X_2$ in FIG. 6A.

Figure 7:
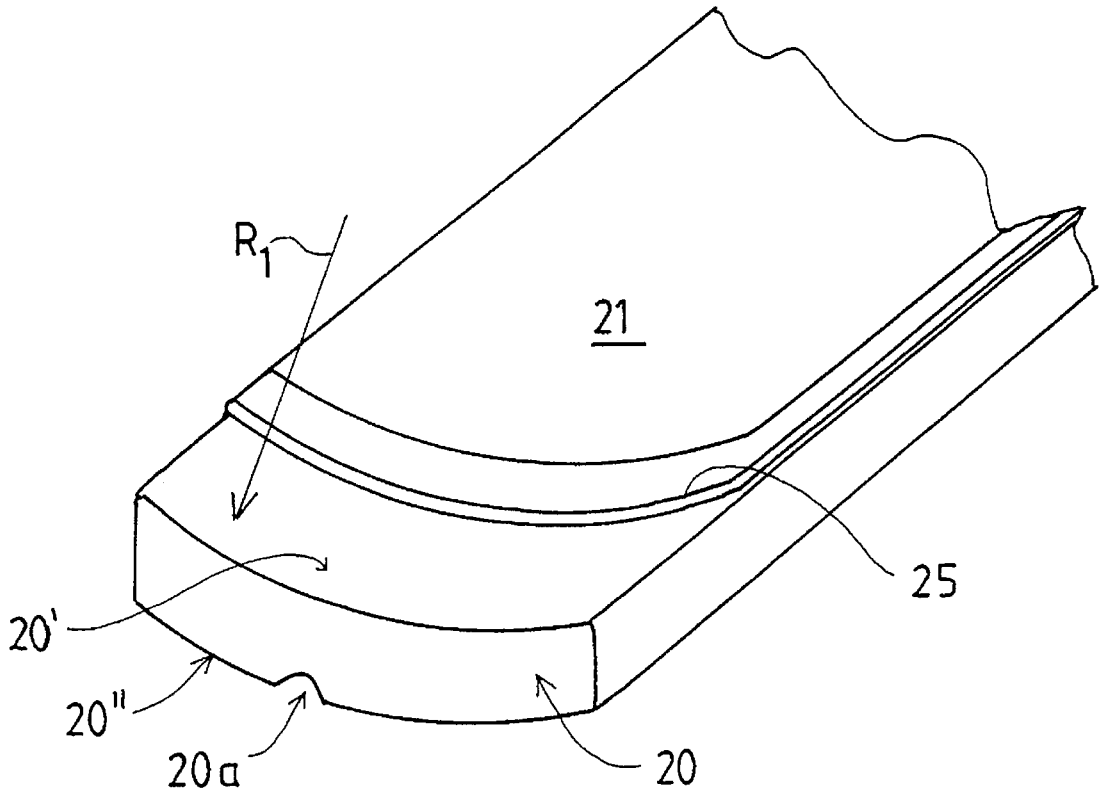
FIG. 7 is an axonometric illustration of the fixing of a grinding band to a backup part of a grinding member.

FIG. 7 illustrates the shape of the grinding back-up part 20 in accordance with the invention and the fixing of the grinding band 21 and the cushion material 25 to the curved face 20' of the grinding back-up part 20. The shape, i.e., radius of curvature, $R_1$ of the face 20' corresponds closely to the radius $R_2$ of the roll 10. In the arrangement, the grinding member 21 is capable of adapting itself to the face 10' to be ground so that any variations in the surface pressure, arising from inaccuracies in the contact between the face 10' to be ground and the grinding member 21, are equalized in the grinding situation. The grinding back-up part 20 comprises a groove **20*a* on its outer face 20", into which groove the end of the blade 29 of the doctor 19 is arranged. Articulated joint 30 is thus formed between the blade 29 and the grinding back-up part 20. In this manner, the grinding back-up part 20 is guided as gently as possible in compliance with the surface forms of the roll in the grinding situation. The time taken by the grinding is preferably one to two hours. The grinding band 21 or any other grinding member is pressed with a force of from about 100 to about 1200 N/m against the roll face 10'** to be ground, and the roll is rotated with a circumferential speed of about 10 to about 200 m/min.

The examples provided above are not meant to be exclusive. Many other variations of the present invention would be obvious to those skilled in the art, and are contemplated to be within the scope of the appended claims.

We claim:

1. Method for conditioning a ceramic or metal-ceramic coating of a paper machine roll having a doctor situated in operative relationship therewith, the doctor comprising a doctor beam, a holder coupled to the doctor beam and a doctor blade retained in the holder and positionable in engagement with a face of the roll, with the roll situated in said paper machine at its operating site, comprising the steps of:

providing an elongate grinding member having grinding particles with a grain size in a range from about 15 μm to about 200 μm, detachably mounting the grinding member on the doctor blade in proximity to the roll, grinding a face of the roll by periodically pressing the grinding member into contact with the roll face while simultaneously rotating the roll, such that if the roll face to be ground is rough, it is smoothed by the grinding member and if the roll face to be ground is smooth, it is roughened by the grinding member, coupling the doctor to a first actuator and a second oscillation actuator, moving the doctor and thus the grinding member to press against the roll face during grinding via the first actuator, and oscillating the grinding member in an axial direction of the roll via the second oscillation actuator.

2. The method of claim 1, wherein the grinding member is pressed against the roll face via the first actuator with a force of about 100 N/m to about 1200 N/m.

3. The method of claim 1, further comprising the steps of:

rotating the roll at a circumferential speed from about 10 m/min to about 200 m/min, and spraying a grinding medium onto the roll face being ground.

4. The method of claim 1, further comprising the step of arranging cushion material between the grinding member and the doctor, the cushion material having the capability of being deformed to permit the grinding member to have a shape similar to the shape of the roll face being ground such that any variations in surface pressure arising from inaccuracies in the contact between the roll face being ground and the grinding member are equalized.

5. The method of claim 1, further comprising the step of providing the grinding member as a grinding band having a width from about 7 mm to about 200 mm.

6. The method of claim 5, wherein the width of the grinding band is from about 10 mm to about 100 mm.

7. The method of claim 1, further comprising the steps of:

arranging the grinding member on a grinding back-up part, coupling the grinding back-up part to an end of the doctor blade, and pivoting the grinding back-up part about an articulation point situated between the grinding back-up part and the doctor blade.

8. The method of claim 1, further comprising the steps of:

arranging the grinding member on a grinding back-up part, providing the grinding back-up part with a curved inner face, and arranging cushion material between the grinding member and the curved inner face of the grinding back-up part.

9. The method of claim 1, wherein said doctor blade is resilient, further comprising the step of:

arranging cushion material between the grinding member and the doctor blade.

10. The method of claim 1, further comprising the step of grinding the roll face until the roll face is smoothed or roughened to a surface roughness value determined by the grinding member.

11. A device for conditioning a ceramic or metal-ceramic coating of a roll in a paper machine in which a doctor is situated in operative relationship with said roll, said doctor comprising a doctor beam, a doctor blade and a blade holder for retaining said doctor blade and for coupling said doctor blade to said doctor beam, comprising grinding means for grinding a face of the roll, support means for supporting said grinding means on said doctor blade, said support means comprising a grinding back-up part, cushion material arranged between said grinding means and said grinding back-up part, and coupling means for detachably coupling said support means to said doctor.

12. The device of claim 11, wherein said grinding means comprise particles having an average particle size in a range from about 15 μm to 200 μm.

13. The device of claim 11, wherein the length of said grinding means in a circumferential direction of the roll over which said grinding means grind the roll face is in the range from about 7 mm to about 200 mm.

14. The device of claim 13, wherein the length of said grinding means in the circumferential direction of the roll is about 10 mm to about 100 mm.

15. The device of claim 11, wherein said grinding back-up part is interposed between said grinding means and said doctor blade and has a groove extending over the length thereof, said groove receiving an end of said doctor blade to form a pivotal articulated joint between said doctor blade and said grinding back-up part.

16. The device of claim 11, wherein said grinding back-up part has a face conforming to the curve form of the roll, said cushion material being arranged between said face of said grinding back-up part and said grinding means.

17. The device of claim 11, wherein said grinding means comprise a diamond grinding band.

18. The device of claim 11, further comprising spray means for directing a grinding medium at the roll face in the vicinity of said grinding means to carry away particles that have been ground loose and to cool the roll face.

19. The device of claim 11, further comprising displacement means for periodically moving said grinding means into contact with the roll face.

20. The device of claim 11, further comprising a doctor blade coupled to said doctor, said coupling means comprising a pivot frame connected to said doctor via an articulated joint and loading means for adjustably loading said pivot frame relative to said doctor, said pivot frame comprising means for retaining said blade.

21. Method for conditioning a ceramic or metal-ceramic coating of a paper machine roll, with the roll situated in said paper machine at its operating site, comprising the steps of:

arranging a grinding member having particles on a grinding back-up part, the particles on the grinding member having a grain size in a range from about 15 μm to about 200 μm, mounting the grinding member on a doctor of the roll in proximity to the roll by coupling the grinding back-up part to an end of a blade of the doctor, pivoting the grinding back-up part about an articulation point situated between the grinding back-up part and the blade, and grinding a face of the roll by periodically pressing the grinding member into contact with the roll face while simultaneously rotating the roll, such that if the roll face to be ground is rough, it is smoothed by the grinding member and if the roll face to be ground is smooth, it is roughened by the grinding member.

22. Method for conditioning a ceramic or metal-ceramic coating of a paper machine roll, with the roll situated in said paper machine at its operating site, comprising the steps of:

arranging a grinding member having particles on a grinding back-up part, the particles on the grinding member having a grain size in a range from about 15 μm to about 200 μm, providing the grinding back-up part with a curved inner face, arranging cushion material between the grinding member and the curved inner face of the grinding back-up part, mounting the grinding member on a doctor of the roll in proximity to the roll, and grinding a face of the roll by periodically pressing the grinding member into contact with the roll face while simultaneously rotating the roll, such that if the roll face to be ground is rough, it is smoothed by the grinding member and if the roll face to be ground is smooth, it is roughened by the grinding member.

23. A device for conditioning a ceramic or metal-ceramic coating of a roll in a paper machine in which a doctor is situated in operative relationship with said roll, comprising grinding means for grinding a face of the roll, support means for supporting said grinding means, said support means comprising a grinding back-up part, coupling means for detachably coupling said support means to said doctor, and cushion material arranged between said grinding means and said grinding back-up part.

24. The device of claim 23, wherein said grinding back-up part has a face conforming to the curve form of the roll, said cushion material being arranged between said face of said grinding back-up part and said grinding means.

25. A device for conditioning a ceramic or metal-ceramic coating of a roll in a paper machine in which a doctor is situated in operative relationship with said roll, said doctor comprising a doctor beam, a doctor blade and a blade holder for retaining said doctor blade and for coupling said doctor blade to said doctor beam, comprising grinding means for grinding a face of the roll, said grinding means comprising an elongate grinding band adapted to extend across a width of the roll, and cushion material arranged between a face of said doctor blade and said grinding band and fixed to said face of said doctor blade.

* * * * *